United States Patent [19]

Ermel et al.

[11] 4,237,943

[45] Dec. 9, 1980

[54] TUNER SUPPLY FOR ELECTROSTATIC COPIERS

[75] Inventors: Heinrich Ermel, Munich; Franz Fruth, Unterpfaffenhofen; Fritz Rau, Unterhaching, all of Fed. Rep. of Germany

[73] Assignee: AGFA-Gevaert, A.G., Leverkusen, Fed. Rep. of Germany

[21] Appl. No.: 31,867

[22] Filed: Apr. 20, 1979

[30] Foreign Application Priority Data

Apr. 22, 1978 [DE] Fed. Rep. of Germany ... 7812275[U]

[51] Int. Cl.[3] ..... B65B 1/06

[52] U.S. Cl. ..... 141/284; 141/364

[58] Field of Search ..... 141/250, 284, 319, 325, 141/326, 327, , 363, 364

[56] References Cited

U.S. PATENT DOCUMENTS

| | | | |
|---|---|---|---|
| 2,762,527 | 9/1956 | Manley | 141/364 |
| 4,062,385 | 12/1977 | Katusha et al. | 141/364 |

*Primary Examiner*—Frederick R. Schmidt

*Attorney, Agent, or Firm*—Michael J. Striker

[57] ABSTRACT

A developer device of an electrostatic copier has a housing provided with an upper opening for admission of toner. A toner supply container has an open side and cooperating parts on the container and housing seive to mount the container on the housing with the open side of the container facing downwardly into the opening so that toner runs from the container into the housing. A slidable closure member on the container can be moved to and fro across the open side to block and unblock the same at the will of a user.

2 Claims, 2 Drawing Figures

1
5
7
6
10
8
11
21
20
16
12
13
9
15
24
14
7
3
4
17
A
18
19
22

TUNER SUPPLY FOR ELECTROSTATIC COPIERS

BACKGROUND OF THE INVENTION

1. Field of the Invention

This invention relates in general to electrostatic copiers.

More particularly, the invention relates to developer devices used in electrostatic copiers.

Still more specifically, the invention relates to an arrangement for supplying toner to such developer devices.

2. The Prior Art

In electrostatic copiers a latent image of electrostatic charges of an original to be copied is produced on the photosensitive surface of a travelling image carrier, typically a rotating copy drum. Thereafter, this image is developed by electrostatically attracting toner particles to it which are then, during further travel of the image carrier, transferred to a copy sheet on which they form a visible image.

Because the supply of toner is used up in making copies, it must be periodically renewed. In one type of copier this is done by pouring fresh toner into the receptacle provided for this purpose in the developer device of the copier. This makes for rather grimy conditions since parts of the copier which in normal use are touched by an operator, become inevitably soiled with toner. Furthermore, there is no way in which the user can readily switch from one type of toner to another, as is sometimes necessary in dependence upon particular copying requirements.

To alleviate some of these problems it has been proposed, in another type of copier, to supply the toner in one-way (i.e., throw-away) containers. These have an opening which is closed by a foil or the like. When such a container is to be used the foil is ruptured as the container is installed on the developer device, with its opening facing in downward direction so that toner from the container is gravity-fed to the developer device. When the toner in the container is used up, the empty container is replaced with a full one.

A drawback of this arrangement is that once the foil is ruptured there is no way to remove the container from the copier without encountering the same soiling problem as in the first-mentioned type of copier. This stands to reason since the downwardly facing opening of the container cannot be reclosed and the toner remaining in the container will inevitably drop out when the container is removed. From time to time there is, however, a definite need to remove such a container even if it is not yet empty, namely if the developer device needs to be serviced or if it is desired to be able to use a different kind of toner.

A rather expensive solution to this problem proposes to construct the container and the toner dosing (metering) device—which normally forms part of the developer device—as a single unit. This does permit the removal of such a mist without soiling of the copier, even if the container is not yet empty of toner material. However, in this construction the dosing device must be discarded together with the container when the same is emptied of toner, and the resultant higher costs and waste of materials are not compensated-for by the increased operating convenience.

SUMMARY OF THE INVENTION

Accordingly, it is a general object of the present invention to overcome the disadvantages of the prior art.

More particularly, it is an object of the invention to provide a toner supply which permits the removal and reinstallation of a toner container which still contains toner, without causing soiling of any parts of the copier.

An additional object is to provide such an improved toner supply in which the above objects are met, but wherein the toner container is nevertheless a separate unit from the dosing device.

Pursuant to the above objects, and still others which will become apparent hereafter, one feature of the invention resides in a toner-supply container for use with a developer device of an electrostatic copier, comprising a receptacle for a supply of toner and having an open side; means on the receptacle for installing the same on the developer device with the open side facing downwardly, so that toner exits through the open side under the influence of gravity; and means on the receptacle for blocking and unblocking the open side at the will of a user, so that in the event of removal of the receptacle from the developer device before the toner supply in the receptacle has been exhausted, the exit of toner from the receptacle can be interrupted to permit such removal without contamination of the copier by exiting toner.

It is particularly advantageous if, according to a further aspect of the invention, the toner container is mountable in a guide which in turn is so secured on the developer device that it can be lifted at least slightly out of its normal operating position. One way of achieving this is to mount the guide on the developer device that it can be tilted relative to the latter about an axis spaced from the closure of the container. This permits the guide—and thereby the container—to be lifted out of engagement with the toner which is still in the developer station, after the container closure has been moved to closed position but before the container is disengaged from the guide. The container can, therefore, then be disengaged from the guide and removed from the copier without any danger that it will drag along toner from the developer device and thus soil the copier.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
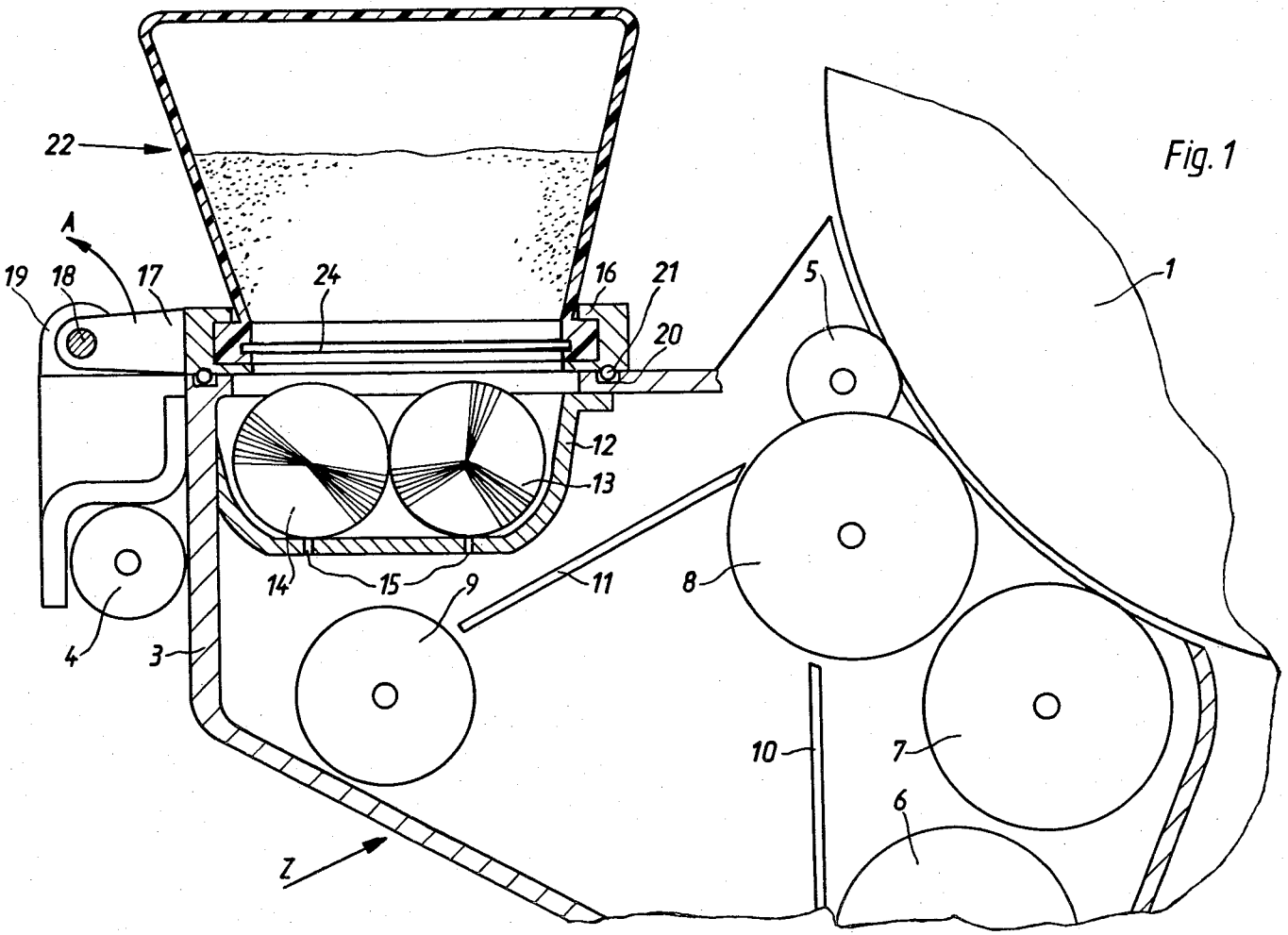
FIG. 1 is a fragmentary section, showing a developer device and a container embodying the invention.

The copy carrier, here in form of a rotatable drum 1, of an electrostatic copier is fragmentarily shown in FIG. 1. Aside from this and the developer device 2, no other details are shown of the copier since such details are known per se and do not form a part of the present invention.

The developer device 2 has a housing 3 formed with a portion 3*a* which defines a downwardly open channel 3*b* (extending normal to the plane of FIG. 1). The portion 3*a* is placed from above over a shaft 4 which is mounted on a stationary part of the copier, e.g., on the frame (not shown), so that the shaft 4 is received in the channel 3*b*. The housing 3 is therefore pivotable about the shaft 4. It is urged towards the drum 1 by not illustrated means (known per se) so that its open side facing the drum is spaced from the photosensitive surface of the drum by a small distance. Spacing rolls 5 (one shown) are turnably mounted on the housing 3 and engage the drum 1 to maintain the desired spacing between the housing and the drum.

Mounted in the housing 3 are a magnetic toner transporting roller 6 which brings up toner from the toner-carrier mixture in the bottom of housing 3 (not shown), magnetic developer rollers 7 and 8 which transfer toner to the surface of drum 1, a mixing roller 9 and toner guide baffles 10 and 11. The upper part of housing 3 is formed with a trough 12 having a bottom wall which is provided with apertures 15. Toner dosing (metering) brush-rollers 13, 14 are mounted for rotation in the trough 12; when they rotate they force toner from the trough 12 through apertures 15 into the housing 3 in precisely metered quantities. This replenishes the toner that is being withdrawn from the toner-carrier mixture in the bottom of housing 3 as copies are being made with the machine.

The preceding description of the elements of device 2, and of the operation thereof, has been provided merely for the sake of completeness, since these details are known per se from the art.

According to the invention a guide frame 16 is located above the trough 12. The frame 16 is of U-shaped outline, i.e., one of its ends (e.g., the one facing away from the viewer of FIG. 1) is open. In addition, the legs of the frame 16 are of U-shaped cross-section. One of the legs is provided with two longitudinally spaced arms 17 (one shown) which are pivotably connected to corresponding lugs 19 (one shown) of the housing 3, by means of a shaft 18. The upper side of the housing 3 is provided with a groove 20 extending around the trough 12 and a sealing ring or strip 21 is lodged in this groove, to provide a seal between housing 3 and frame 16 when the latter rests on the sealing ring 21, as shown.

Figure 2:
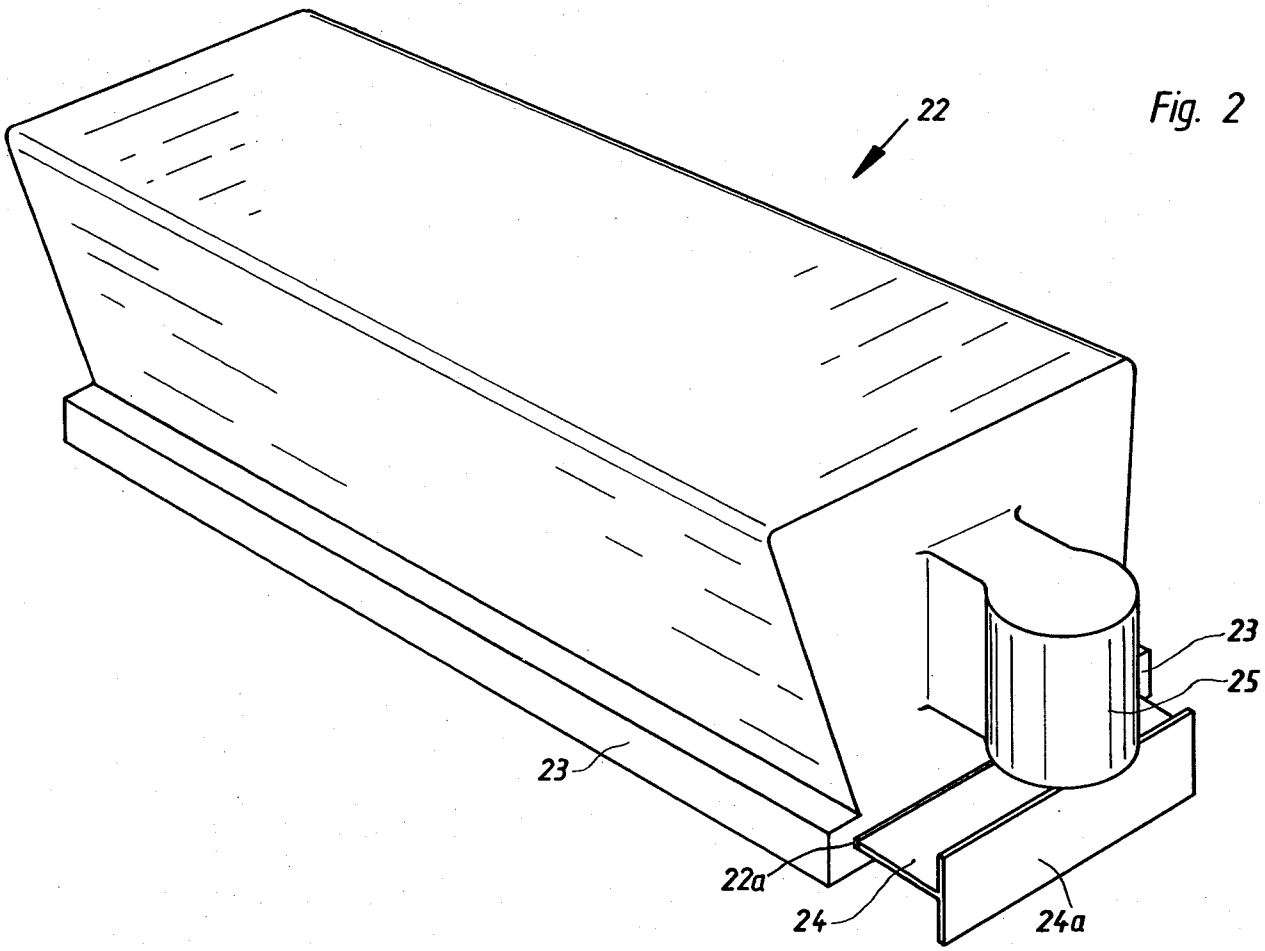
FIG. 2 is a perspective view of the container shown in FIG. 1.

A toner container or cassette 22 (FIG. 2) is provided with two elongated guide portions 23 so that it can be connected to frame 16 by sliding these portions 23 into the recesses in the U-shaped legs of the frame 16 (FIG. 1). The container 22 accommodates a supply of toner (see FIG. 1) and has an open lower side through which the toner can drop under the influence of gravity into the trough 12. The wall bounding the open side is formed at opposite sides with grooves 22*a* (compare FIGS. 1 and 2) in which a plate-like closure 24 can slide to open or block the open side at the will of a user. One end of the closure 24 is preferably provided with a handle 24*a* to facilitate sliding of the closure. One end of container 22 is preferably also provided with a handle 25, again to facilitate sliding of the container.

To install a new container 22 on the device 2 it is merely necessary to slide its guide portions 23 into the recesses of the legs of frame 16 from the open side of the latter, until the container is properly in place on the frame. Then the closure 24 is moved to open position so that toner can drop through the open side of the container into the trough.

When the need arises to remove the container 22 before it is empty, i.e., to perform maintenance on the device 2 or to replace the container with another one which supplies a different type of toner, the closure 24 is moved back to its closure position in which it blocks the open side of the container. Thereafter the frame 16 with the container 22 is slightly raised, by pivoting in the direction of the arrow A, until the lower side of container 22 (i.e., the closure 24) moves out of contact with toner still located in the trough 12. The container 22 can then be pulled out of the frame 16 without any danger that it might take along some of the toner from trough 12 and cause soiling of any parts of the machine. A replacement container (or the same container) is installed in reverse sequence and with the frame 16 in the aforementioned slightly lifted position; subsequent to such installation the frame 16 is returned to its operating position (FIG. 1) and the closure moved to open position.

It will be seen that this arrangement makes it possible to withdrawn and install partially filled containers of toner at will without danger of soiling parts of the copier, and yet maintains the container completely separate from the dosing device (elements 12, 14, 15) so that no unavoidable expenses or waste of materials are incurred.

While the invention has been illustrated and described as embodied in an electrostatic copier, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In an electrostatic copier, a combination comprising a developer device having a housing provided with an opening; a toner supply container having an open side with which said opening is juxtaposed when said container is installed on said housing; cooperating means on said housing and container for installing the container on said housing with said open side facing downwardly, for gravity movement of the toner through said open side of the container into said housing; a closure on said container for selectively blocking and unblocking said open side at the will of a user, said closure including a closure member slidably mounted on said container so as to respectively extend across, and be withdrawn from, said open side; and a container mounting element on which said container is installed, said mounting element being connected to said housing for movement between an operating position in which it holds said container with said open side directly proximal to said opening, and a container installing and removing position in which it holds said container with said open side thereof at least slightly spaced from said opening, said mounting element including mounting means mounting it on said housing for tilting movement between said positions about a pivot axis.

2. A combination as defined in claim 1, said pivot axis being defined by a shaft mounted on said container laterally spaced from the slidable closure member and located in a plane which is coincident with the general plane of said slidable closure member when said mounting element is in said operating position thereof.

* * * * *